US011420086B1

(12) United States Patent
Nolan

(10) Patent No.: US 11,420,086 B1
(45) Date of Patent: Aug. 23, 2022

(54) PORTABLE EXERCISE TRAINING RIG SYSTEM

(71) Applicant: Nicole Nolan, Santa Clarita, CA (US)

(72) Inventor: Nicole Nolan, Santa Clarita, CA (US)

( * ) Notice: Subject to any disclaimer, the term of this patent is extended or adjusted under 35 U.S.C. 154(b) by 0 days.

(21) Appl. No.: 17/078,270

(22) Filed: Oct. 23, 2020

(51) Int. Cl.
*A63B 1/00* (2006.01)

(52) U.S. Cl.
CPC ..... *A63B 1/00* (2013.01); *A63B 2210/58* (2013.01); *A63B 2225/093* (2013.01); *A63B 2225/685* (2013.01); *A63B 2225/687* (2013.01)

(58) Field of Classification Search
CPC . A63B 1/00; A63B 2210/58; A63B 2225/687; A63B 2225/685; A63B 2225/093; A63B 21/4035; A63B 21/0552; A63B 21/068; A63B 21/0442; A63B 23/03525; A63B 2225/50; A63B 2230/06; A45F 4/02
See application file for complete search history.

(56) References Cited

U.S. PATENT DOCUMENTS 4,961,573 A * 10/1990 Wehrell ..... A63B 21/0552 482/124
5,518,481 A * 5/1996 Darkwah ..... A63B 21/0004 482/126
7,565,990 B2 * 7/2009 Bryan, IV ..... A63B 21/00047 224/282
7,644,810 B2 * 1/2010 Duncan ..... A63B 71/0036 190/8
8,641,056 B1 * 2/2014 Carter ..... B62B 1/12 280/30
9,339,698 B2 * 5/2016 Zhang ..... A63B 47/02
9,744,400 B2 * 8/2017 Cole ..... A47B 81/00
10,413,771 B1 * 9/2019 Del Conte ..... A63B 21/05
10,471,291 B2 * 11/2019 Alves Mourao ..... A63B 23/00
10,702,047 B1 * 7/2020 Younan ..... A63B 21/4029
10,960,256 B2 * 3/2021 Donnelly ..... B65D 21/0204
11,000,735 B2 * 5/2021 Orady ..... A63B 24/0059
2008/0023282 A1 * 1/2008 Duncan ..... A47C 16/02 190/1
2008/0128463 A1 * 6/2008 Bryan ..... B60R 9/06 224/486
2014/0374456 A1 * 12/2014 Zhang ..... A63B 47/002 224/576
2017/0197109 A1 * 7/2017 Cole ..... A47C 17/52

* cited by examiner

*Primary Examiner* — Garrett K Atkinson

(74) *Attorney, Agent, or Firm* — Leavitt Eldredge Law Firm

(57) ABSTRACT

A training rig system comprising of equipment callable of folding and collapsing into a compact unit. The compact unit allows the training rig system to be readily portable.

2 Claims, 5 Drawing Sheets

PORTABLE EXERCISE TRAINING RIG SYSTEM

BACKGROUND

1. Field of the Invention

The present invention relates generally to exercise systems, and more specifically to an exercise system comprising of training rig equipment capable of collapsing into a self-contained unit for portability.

2. Description of Related Art

Exercise systems are well known in the art and are effective means to facilitate physical fitness for individuals. Many exercise systems exist in fitness gyms and athletic facilities and other exercise systems are available for consumers for at home use. Commonly in the art, exercise systems utilize training rig equipment for weight and resistance training.

One of the problems commonly associated with this is limited portability. For example, many exercise systems that use training rig equipment are built to remain stationary in a room and are generally large and difficult to handle. Moreover, these exercise systems are not designed for quick and easy breakdown. There exists a need for exercise systems to be portable so that a user may carry the exercise system readily to any desired location.

Accordingly, although great strides have been made in the area of exercise systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
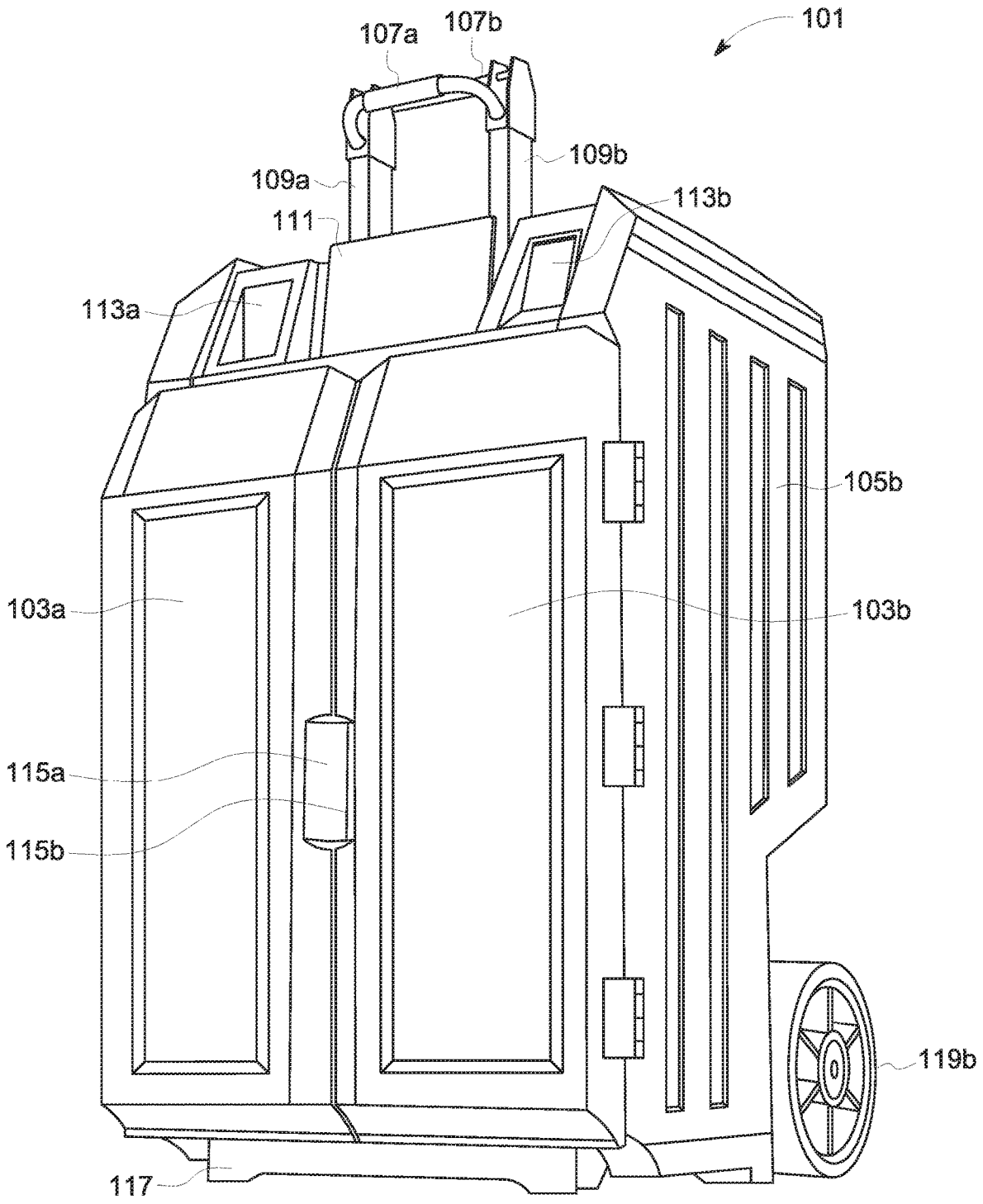
FIG. 1 is a perspective view of a preferred embodiment of the portable exercise training rig system of the present application, with the system in a closed position.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise systems. Specifically, the system of the present invention allows for easy assembly and dismantling of training rig systems by providing a collapsible equipment that stores into a self-contained unit in the size of a piece of luggage for individuals on-the-go. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a perspective view of a portable exercise training rig system in accordance with a preferred embodiment of the present application. It will be appreciated that system 101 overcomes one or more of the above-listed problems commonly associated with conventional training rig systems.

In the contemplated embodiment, system 101 comprises of door openings 103*a*, 103*b*, back panels (105*a* not shown), 105*b*, a bottom portion 117, wheels (119*a* not shown), 119*b*, and handles 107*a*, 107*b* attached to retractable posts 109*a*, 109*b*. The door flaps 103*a*, 103*b* incorporate door handles 115*a*, 115*b* for interior access. System 101 also comprises of one or more alcoves 113*a*, 113*b* which incorporate speakers (not shown). System 101 also includes a recess 111 which accommodates smart devices (not shown) such as a smart phone, tablet, and the like. The recess 111 incorporates USB charging ports (not shown) and volume controls (not shown) for the speakers within the one or more alcoves 113*a*, 113*b*.

It is also contemplated and will be appreciated that system 101 is made of polyethylene plastic, hollow steel tubing, or other suitable material.

It should also be appreciated that one of the unique features believed characteristic of the present application is the convenience of dismantling a training rig system into a luggage-style shape for easy portability.

Figure 2:
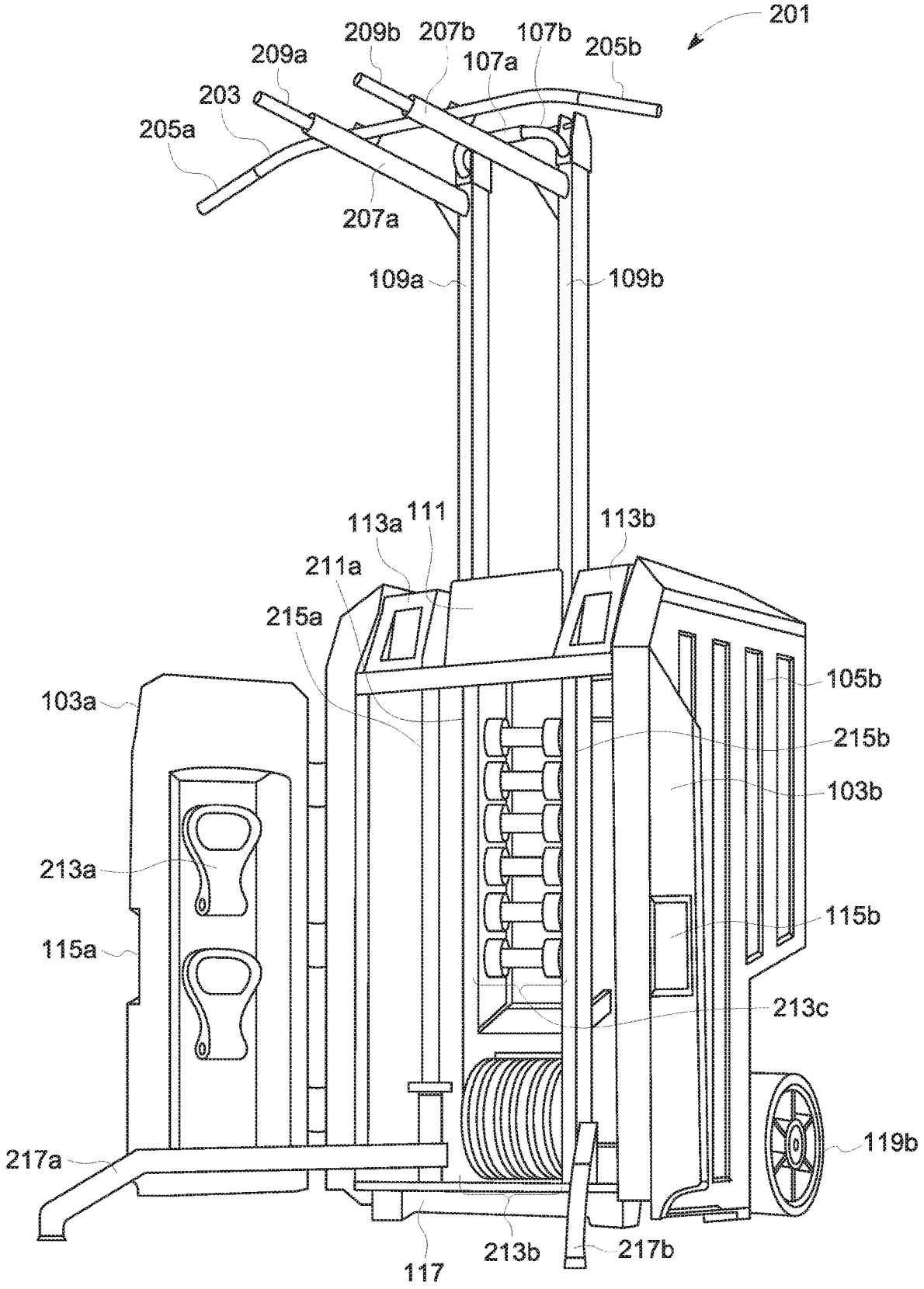
FIG. 2 is a perspective view of a preferred embodiment of the portable exercise training rig system of the present application, with the system in an opened position.

Referring now to FIG. 2, a perspective view of the portable exercise training rig system in an opened position is shown. The retractable posts 109*a*, 109*b* extends vertically up which allows for the attachment of a primary pullup bar 203 with grip handles 205*a*, 205*b*, secondary pullup bars 207*a*, 207*b* with grip handles 209*a*, 209*b*. Leg supports 217*a*, 217*b* fold outward to provide stability and support during use.

When the door flaps 103*a*, 103*b* open, interior framing 215*a*, 215*b* provide space for the storage of a plurality of exercise equipment such as aerobic barbells 213*a*, aerobic barbell plate weights 213*b*, and aerobic dumbbells 213*c*. It should be appreciated that exercise equipment may include kettle grips, resistance bands, aerobic platform, and a detachable cushion for bench functions.

Figure 3A:
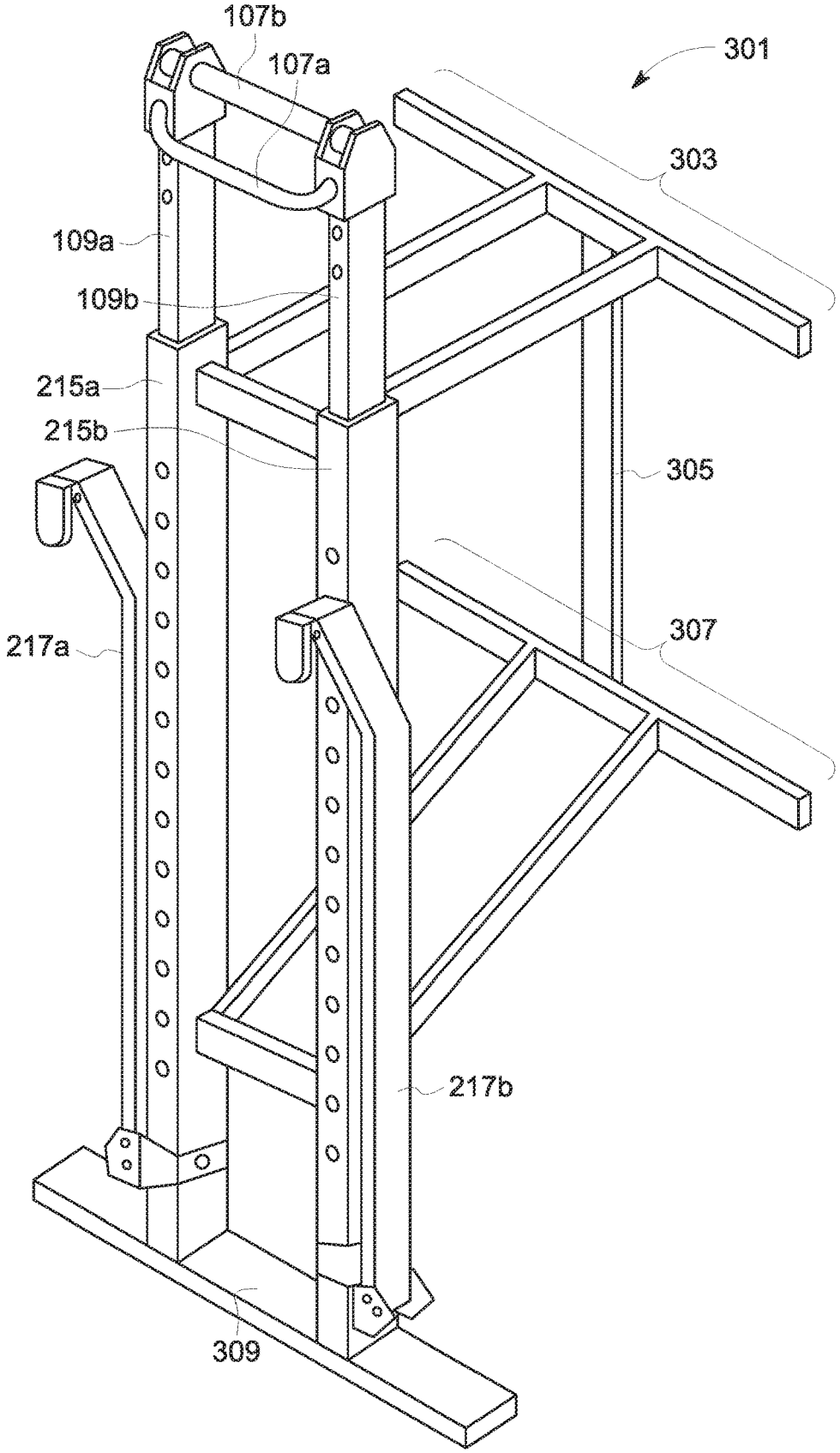
FIG. 3A is a schematic view of a preferred embodiment of the interior frame of the portable exercise training rig system of the present application, with the interior frame in a closed position.
Figure 3B:
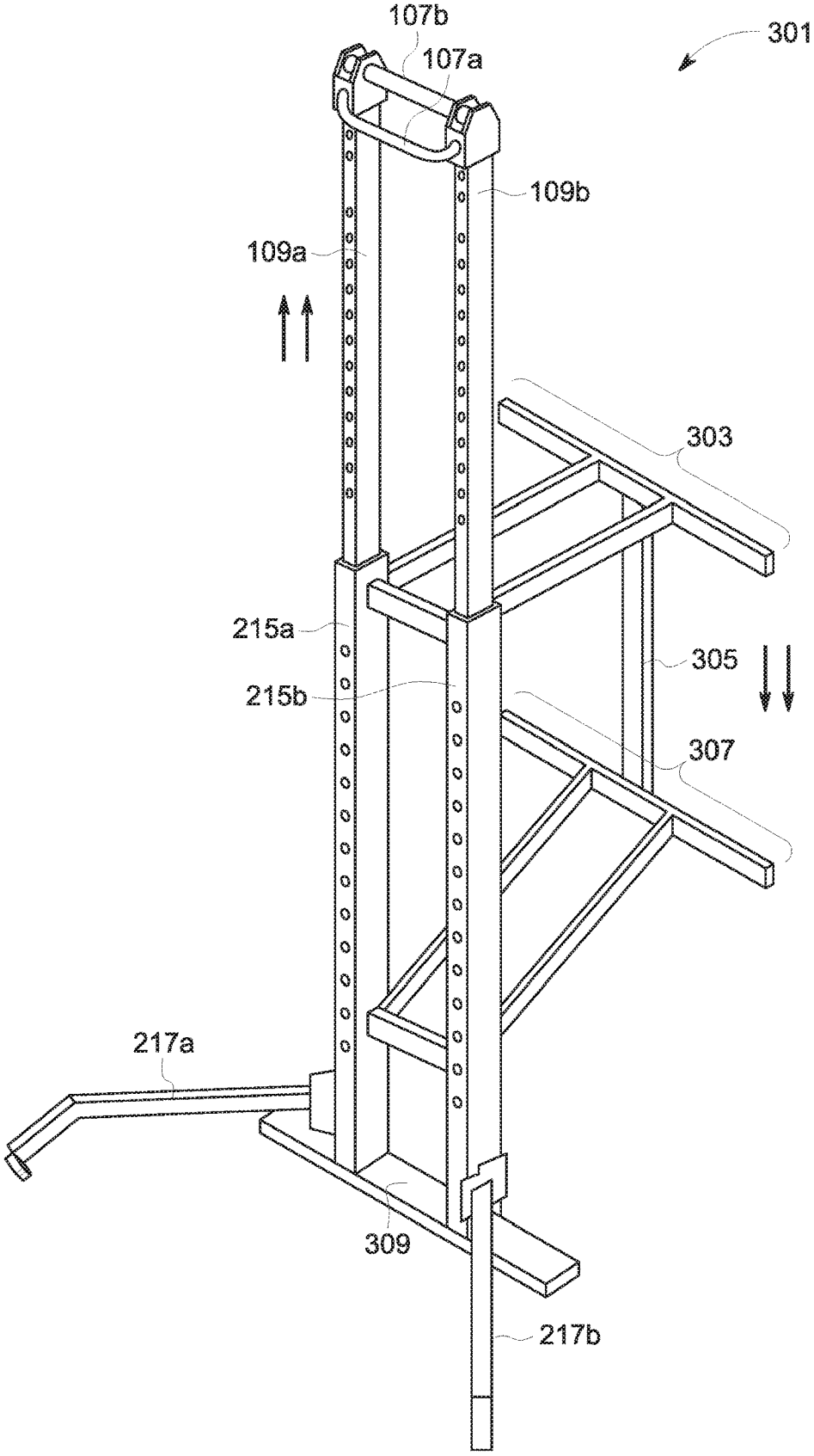
FIG. 3B is a schematic view of a preferred embodiment of the interior frame of the portable exercise training rig system of the present application, with the interior frame in an opened position.

Referring now to FIGS. 3A and 3B, a schematic view of a preferred embodiment of the interior frame of the portable exercise training rig system is shown. When system 101 is in a closed position, the top portion frame 303, the connecting frame 305, and the bottom portion frame 307 lock into an upward position with the base frame 309 remaining stationary. When system 101 is in an opened position, the top portion frame 303, the connecting frame 305, and the bottom portion frame 307 move downward as shown with directional arrows. The retractable posts 109*a*, 109*b* extend upward as shown with directional arrows to allow access for the attachment of other exercise equipment such as the primary pullup bar 203 and secondary pullup bars 207*a*, 207*b* mentioned above.

Figure 4:
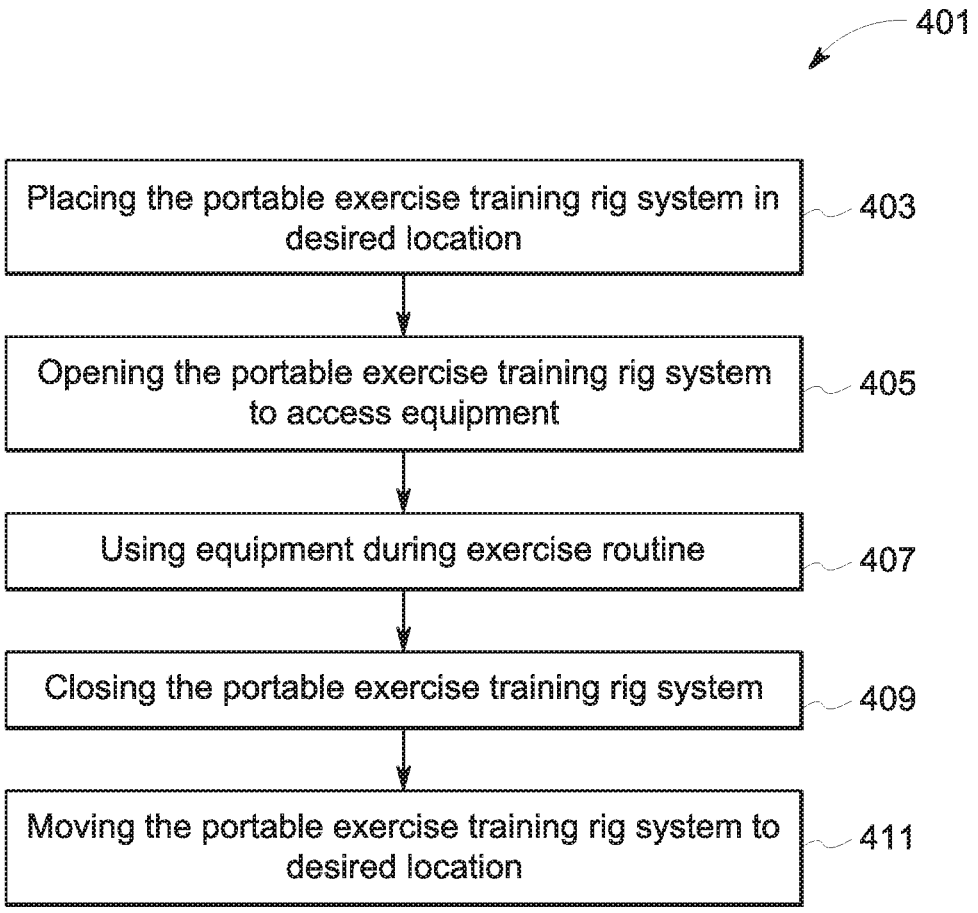
FIG. 4 is a flowchart of a method of use associated with the portable exercise training rig system in accordance with a preferred embodiment of the present application.

FIG. 4 depicts a method of use 401 associated with system 101. During use, the portable exercise training rig system is placed in a desired location, as shown with box 403. The portable exercise training rig system is opened to access the equipment therein to be used during an exercise routine, as shown with boxes 405, 407. The portable exercise training rig system is closed and is ready to move to a desired location, as shown with boxes 409, 411.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A portable exercise training rig system, comprising:
- a body, the body having:
  - an interior portion; and
  - an exterior portion extending from a first end to a second end;
  - wherein the interior portion includes a plurality of components; and
  - wherein the exterior portion comprises of a front portion having one or more door openings, a bottom portion, a rear portion, a top portion, and side portions;
- a plurality of wheels secured to the first end;
- a leg support pivotally attached to and extending from the first end, the leg support secured to an interior framing disposed within the interior portion;
- a retractable post adjustably attached to the second end;
- a pullup bar secured to the retractable post;
- wherein the body is shaped as a luggage container;
- wherein the body is configured to readily assemble into a training rig thereof; and
- wherein the body is configured to readily dismantle the training rig back therein.

2. The system of claim 1, wherein the front portion further comprises:
- one or more alcoves; and
- one or more recesses;
- wherein the one or more alcoves are configured to incorporate speakers;
- wherein the one or more recesses are configured to receive the attachment of one or more smart devices;
- wherein the one or more recesses are configured to incorporate a control panel for speakers.

* * * * *